US008689518B2

(12) United States Patent
Gridley et al.

(10) Patent No.: US 8,689,518 B2
(45) Date of Patent: Apr. 8, 2014

(54) CONTINUITY TIE FOR PREFABRICATED SHEARWALLS

(75) Inventors: Jerry G. Gridley, Grass Valley, CA (US); Emory Montague, Pleasanton, CA (US); Paul McEntee, Pleasanton, CA (US); Ricardo Arevalo, Pleasanton, CA (US)

(73) Assignee: Bay City Flower Company, Inc., Half Moon Bay, CA (US)

( * ) Notice: Subject to any disclaimer, the term of this patent is extended or adjusted under 35 U.S.C. 154(b) by 0 days.

(21) Appl. No.: 12/449,962

(22) PCT Filed: Mar. 6, 2008

(86) PCT No.: PCT/US2008/003033

§ 371 (c)(1),
(2), (4) Date: May 28, 2010

(87) PCT Pub. No.: WO2008/109139

PCT Pub. Date: Sep. 12, 2008

(65) Prior Publication Data

US 2010/0229495 A1 Sep. 16, 2010

Related U.S. Application Data

(60) Provisional application No. 60/905,367, filed on Mar. 6, 2007.

(51) Int. Cl.
*E04B 1/38* (2006.01)
*E04C 5/00* (2006.01)

(52) U.S. Cl.
USPC ..... 52/713; 52/293.3; 52/223.13; 52/167.1; 52/92.2

(58) Field of Classification Search
USPC ..... 52/293.3, 223.13, 223.14, 712, 713, 52/236.3, 167.1, 92.2, 705
See application file for complete search history.

(56) References Cited

U.S. PATENT DOCUMENTS

| | | | | |
|---|---|---|---|---|
| 2,138,291 | A * | 11/1938 | Callaghan | 52/290 |
| 2,191,804 | A | 2/1940 | O'Malley | |
| 4,321,776 | A | 3/1982 | Delight | |
| 4,441,286 | A | 4/1984 | Skvaril | |
| 5,375,384 | A | 12/1994 | Wolfson | |
| 5,619,837 | A * | 4/1997 | DiSanto | 52/798.1 |
| 5,706,626 | A | 1/1998 | Mueller | |
| 5,782,054 | A | 7/1998 | Voraglu et al. | |
| 5,904,025 | A | 5/1999 | Bass et al. | |
| 5,921,042 | A * | 7/1999 | Ashton et al. | 52/291 |

(Continued)

FOREIGN PATENT DOCUMENTS

JP 2003293847 10/2003

OTHER PUBLICATIONS

LBN—Light Beam, Inc. Steel Homes.

(Continued)

*Primary Examiner* — Brian Glessner
*Assistant Examiner* — Brian D Mattei
(74) *Attorney, Agent, or Firm* — James R. Cypher; Charles R. Cypher

(57) ABSTRACT

A continuity tie is provided for connecting a prefabricated shearwall to a structural member above the prefabricated shearwall. In the preferred embodiment, the continuity tie is a steel tube with aligned openings for receiving a threaded rod therethrough. The tube is welded to the shearwall. A pair of tubes are preferably attached. Nuts attach the threaded rod to the tube. The threaded rod attaches to a structural member above the tube.

20 Claims, 6 Drawing Sheets

(56) References Cited

U.S. PATENT DOCUMENTS

| | | | | |
|---|---|---|---|---|
| 5,987,828 | A | 11/1999 | Hardy | |
| 6,006,487 | A | 12/1999 | Leek | |
| 6,148,583 | A | 11/2000 | Hardy | |
| 6,158,184 | A | 12/2000 | Timmerman et al. | |
| 6,212,849 | B1 | 4/2001 | Pellock | |
| 6,240,695 | B1 | 6/2001 | Karalic et al. | |
| 6,260,323 | B1 | 7/2001 | Hockey | |
| 6,298,612 | B1 | 10/2001 | Adams | |
| 6,308,469 | B1 | 10/2001 | Leung | |
| 6,327,831 | B1 | 12/2001 | Leek | |
| 6,389,767 | B1 * | 5/2002 | Lucey et al. | 52/295 |
| 6,453,634 | B1 | 9/2002 | Pryor | |
| 6,481,175 | B2 | 11/2002 | Potter | |
| 6,484,460 | B2 | 11/2002 | VanHaitsman | |
| 6,513,290 | B2 | 2/2003 | Leek | |
| 6,550,200 | B1 * | 4/2003 | Mueller | 52/296 |
| 6,560,940 | B2 | 5/2003 | Mueller | |
| 6,625,945 | B2 | 9/2003 | Commins | |
| 6,643,986 | B2 | 11/2003 | Commins et al. | |
| 6,668,508 | B2 | 12/2003 | Boone et al. | |
| 7,007,432 | B2 * | 3/2006 | Commins | 52/293.3 |
| 7,168,343 | B2 | 1/2007 | Leek et al. | |
| 7,251,920 | B2 | 8/2007 | Timmerman et al. | |
| 7,296,386 | B2 | 11/2007 | Leek | |
| 7,506,479 | B2 | 3/2009 | Pryor | |
| 7,509,777 | B2 | 3/2009 | Nakaki et al. | |
| 7,513,083 | B2 | 4/2009 | Pryor et al. | |
| 7,712,282 | B2 | 5/2010 | Robertson et al. | |
| 8,112,968 | B1 | 2/2012 | Mueller | |
| 2003/0009964 | A1 * | 1/2003 | Trarup et al. | 52/295 |
| 2003/0230032 | A1 * | 12/2003 | Shahnazarian et al. | 52/167.3 |
| 2004/0068947 | A1 | 4/2004 | Commins et al. | |
| 2005/0126105 | A1 * | 6/2005 | Leek et al. | 52/633 |
| 2007/0022704 | A1 * | 2/2007 | Pryor | 52/712 |
| 2007/0062135 | A1 | 3/2007 | Mueller | |
| 2007/0110513 | A1 * | 5/2007 | Fujihashi et al. | 403/364 |

OTHER PUBLICATIONS

Typical CS Installation as a Floor-to-Floor Tie with Strap Attached over Plywood, 1 page.

* cited by examiner

FIG. 4
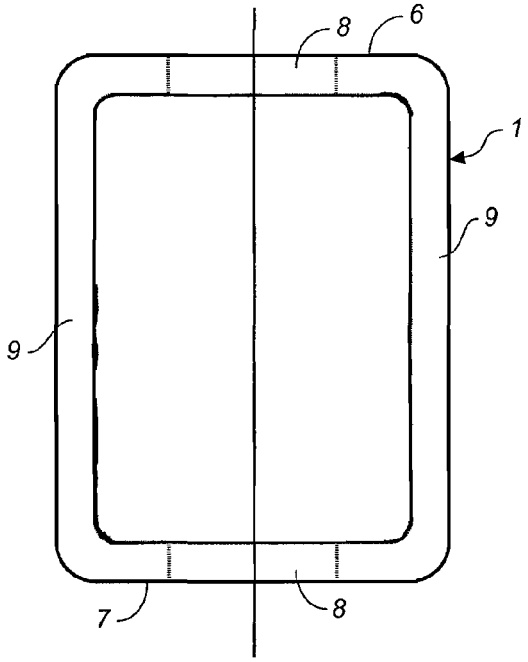
FIG. 5
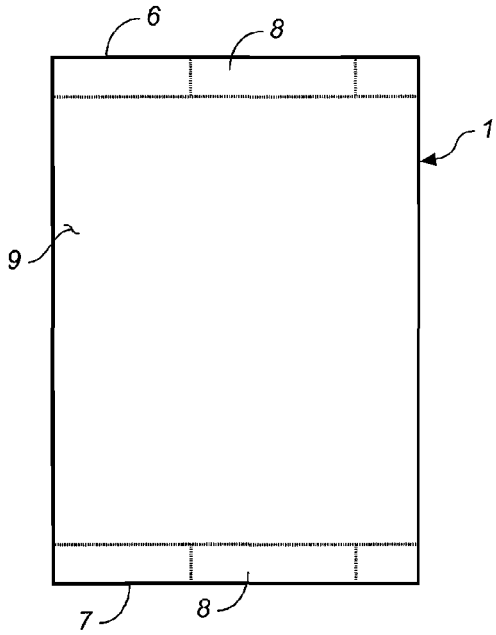
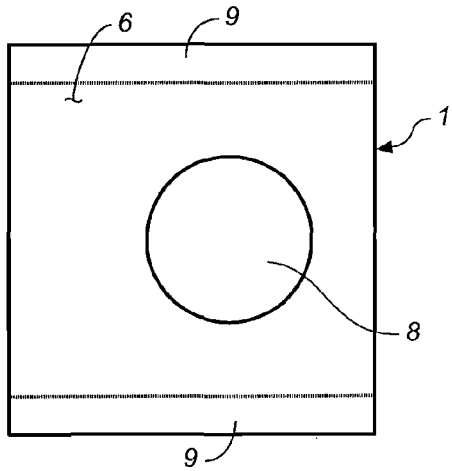
FIG. 6

CONTINUITY TIE FOR PREFABRICATED SHEARWALLS

BACKGROUND OF THE INVENTION

1. Field of the Invention

The present invention relates to a shearwalls for opposing lateral forces on building walls, and in particular to a pair of prefabricated shearwalls, one disposed above the other, that are connected together by a pair of ties.

2. Description of the Related Art

Prefabricated shearwalls were developed to counteract the potentially devastating effects of natural phenomena such as seismic activity, high winds, floods and snow loads on the structural integrity of light-framed constructions.

When shearwalls are used on more than one story of a building, it becomes more difficult to properly anchor shearwalls on upper stories of a building. The present invention provides a solution for anchoring an upper story shearwall or other structural member to a lower story shearwall or other structural member.

SUMMARY OF THE INVENTION

The present invention provides a shearwall having improved structures for anchoring an upper story shearwall to a lower story shearwall.

The present invention provides a lower shearwall with an improved point of attachment of a continuity tie.

In the preferred embodiment, the prefabricated shearwall includes a central diaphragm having a height generally defined by top and bottom edges, and a width generally defined by a pair of end sections. The diaphragm further includes at least one corrugation extending in the height direction at least partially between the top and bottom edges. The corrugation increases the cross-sectional area and ductility of the diaphragm in the lateral direction in comparison to conventional shearwalls, and further improves the resistance of the shearwall to lateral forces such as those generated in earthquakes, high winds, floods and snow loads.

In embodiments of the invention, the shearwall may further include a pair of reinforcing chords affixed to the end sections of the central diaphragm. The chords may be formed of nominal 2"×4" wooden studs having a height equal to that of the central diaphragm. The chords further improve the resistance of the shearwall to lateral forces.

In order to distribute the significant compressive forces exerted by the shearwall over a large surface area on the underlying support surface, the shearwall further includes a flat sill plate affixed to the bottom edge of the central diaphragm. In embodiments of the invention, the sill plate may have a footprint at least equal to that of the central diaphragm, the chords and any sheathing affixed to the shearwall. The sill plate may be formed of a rigid material such as steel to evenly distribute any localized compressive forces from the shearwall. The sill plate may also underlie the chords to prevent any wetness or moisture from the underlying support surface from damaging the chords.

While a preferred embodiment of the invention includes a central diaphragm with a corrugation having a constant size and shape from the top edge to the bottom edge, the corrugation may be formed so that it is larger at the bottom edge of the central diaphragm and slopes inward to become smaller toward the top edge of the central diaphragm (or visa-versa). This results in a shearwall providing even greater lateral force resistance, as the sloped lines defined by the bends at the intersection between the various diaphragm sections have lateral components that exhibit increased resistance to movement in the lateral direction.

BRIEF DESCRIPTION OF THE FIGURES

FIG. 4 is a front view of the tubular continuity. The wall thickness of the continuity tie shown is ½ of an inch.

FIG. 5 is a side view of the continuity tie.

FIG. 6 is a top view of the continuity tie with a bolt opening. The continuity tie has a width of 2½ inches and a depth of 3½ inches. The bolt openings in the top and bottom surfaces have a diameter of 1.125 inches.

DETAILED DESCRIPTION OF THE INVENTION

Figure 1:
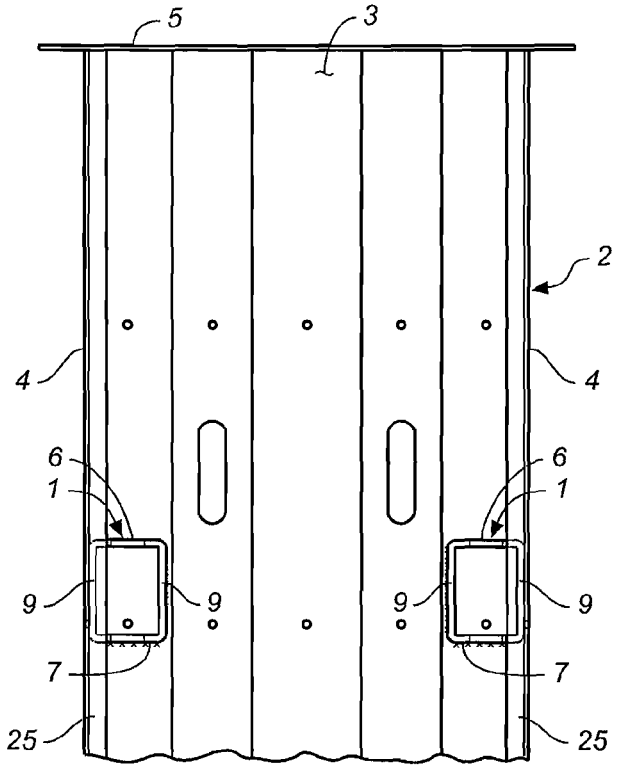
FIG. 1 is a front partial view of a prefabricated shearwall showing tubular continuity ties mounted on the shearwall. The continuity ties shown are made from steel tube sections, which is the preferred material, but any material that can withstand the design tension and compression forces for securing a prefabricated shearwall in a light-frame construction will suffice.
Figure 2:
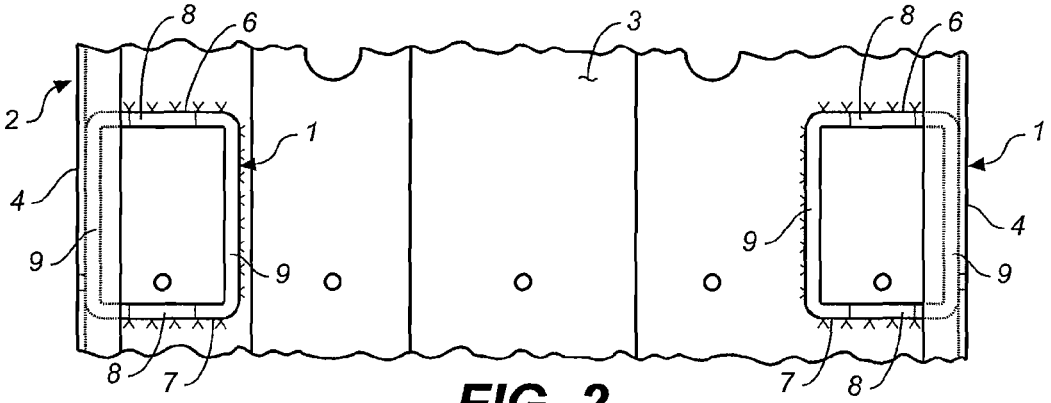
FIG. 2 is a front partial view showing continuity ties. The continuity ties shown are approximately 3½ inches high. The continuity ties shown are approximately 2½ inches wide.
Figure 3:
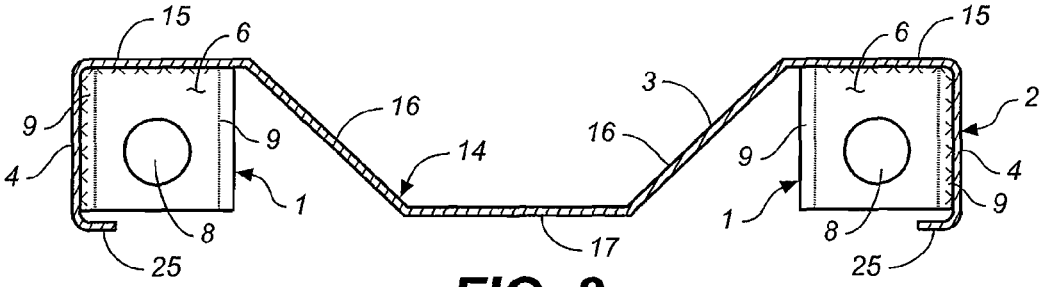
FIG. 3 is a top cross sectional view of the continuity ties. The hatch marks show top welds with a thickness of 3/16 of an inch. The bottom surface of the continuity ties are similarly welded to the end and diaphragm of the shearwall.
Figure 7:
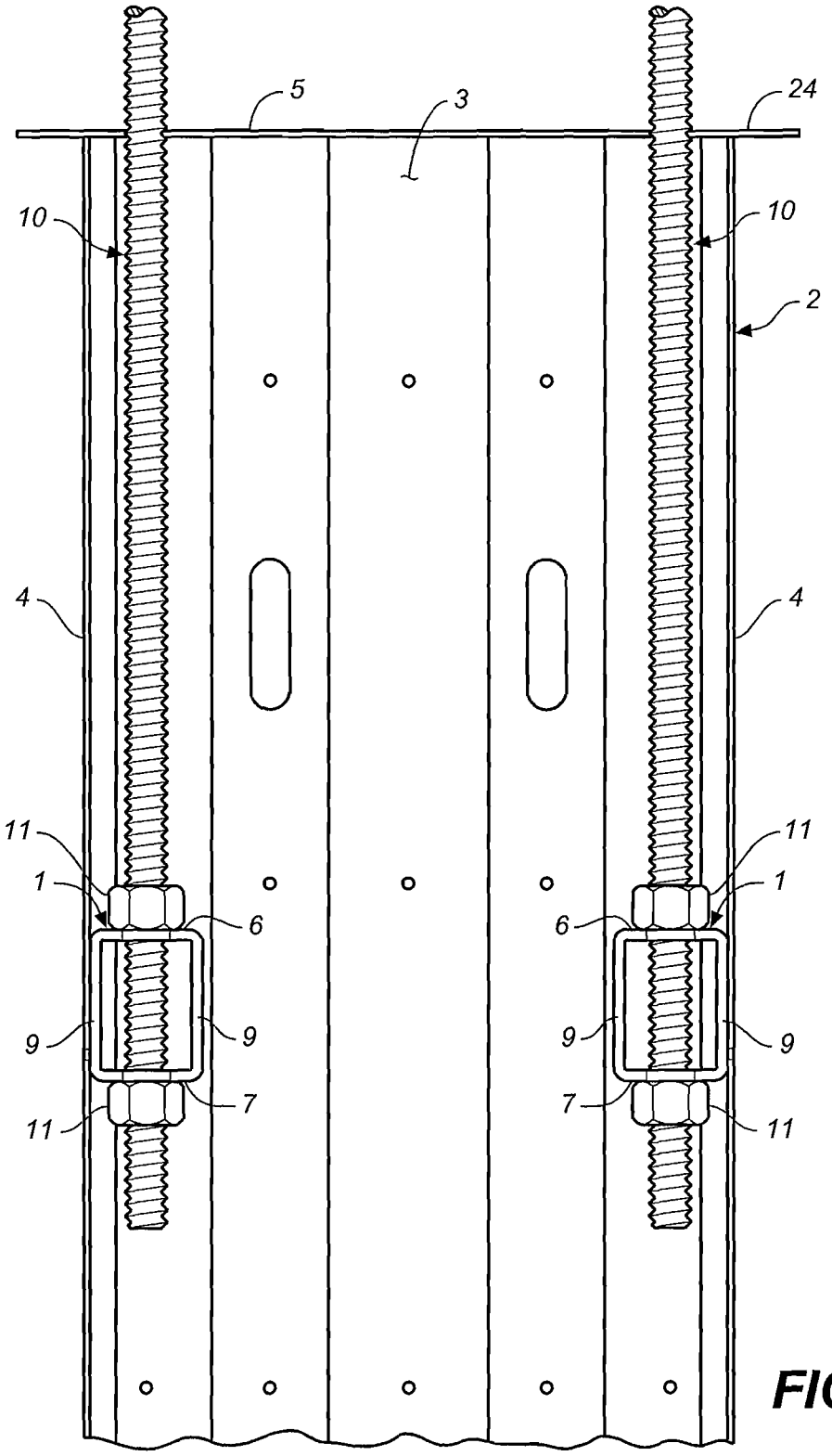
FIG. 7 is a front view showing the continuity ties with bolts received thereby. The measurement from the top of the continuity tie to the top of the prefabricated shearwall is approximately 1 foot and 6 inches.
Figure 8:
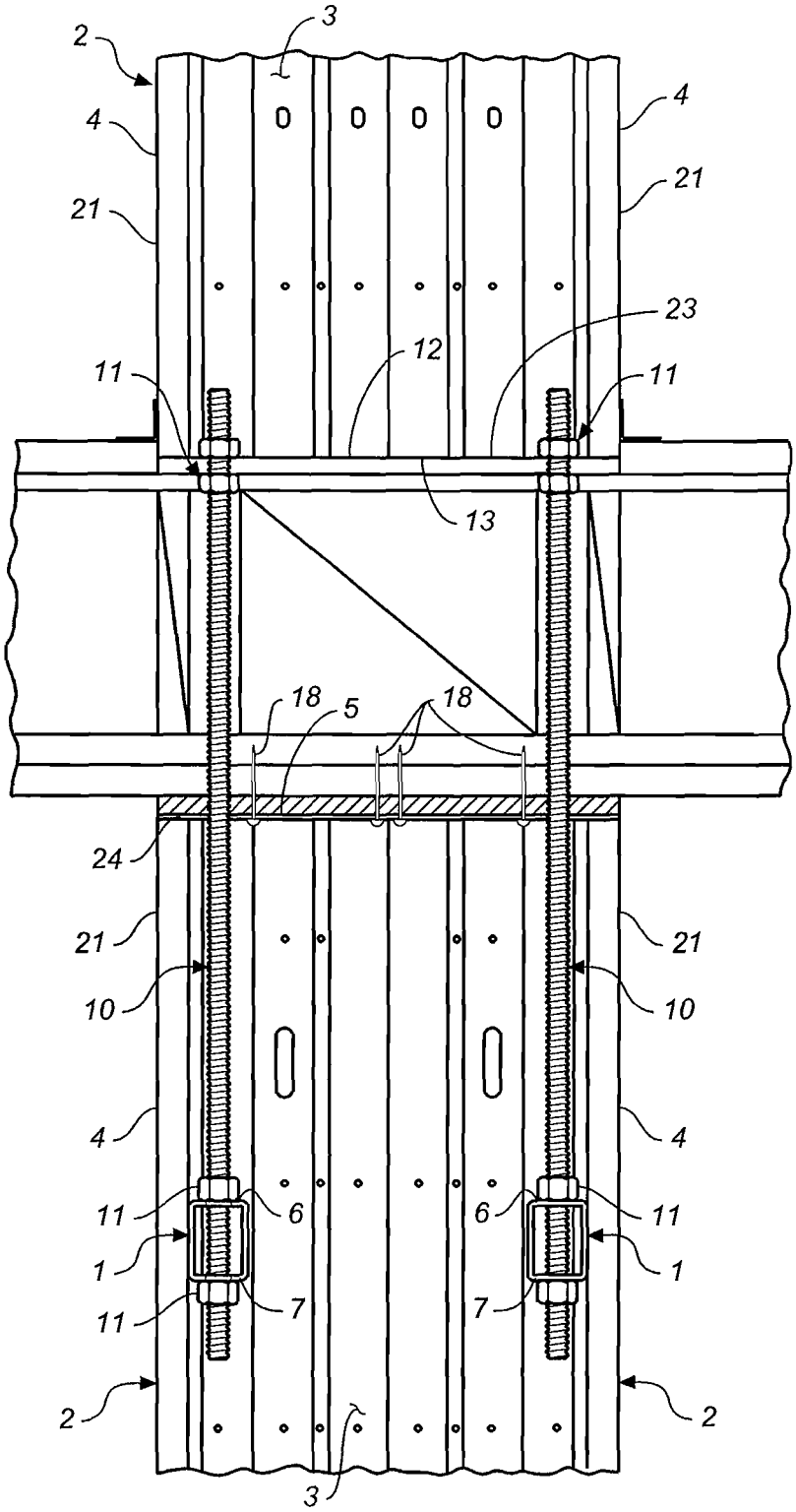
FIG. 8 is a interior elevation view of two prefabricated walls connected together by a threaded rod, the lower wall having a continuity tie of the present invention in a two story installation.
Figure 9:
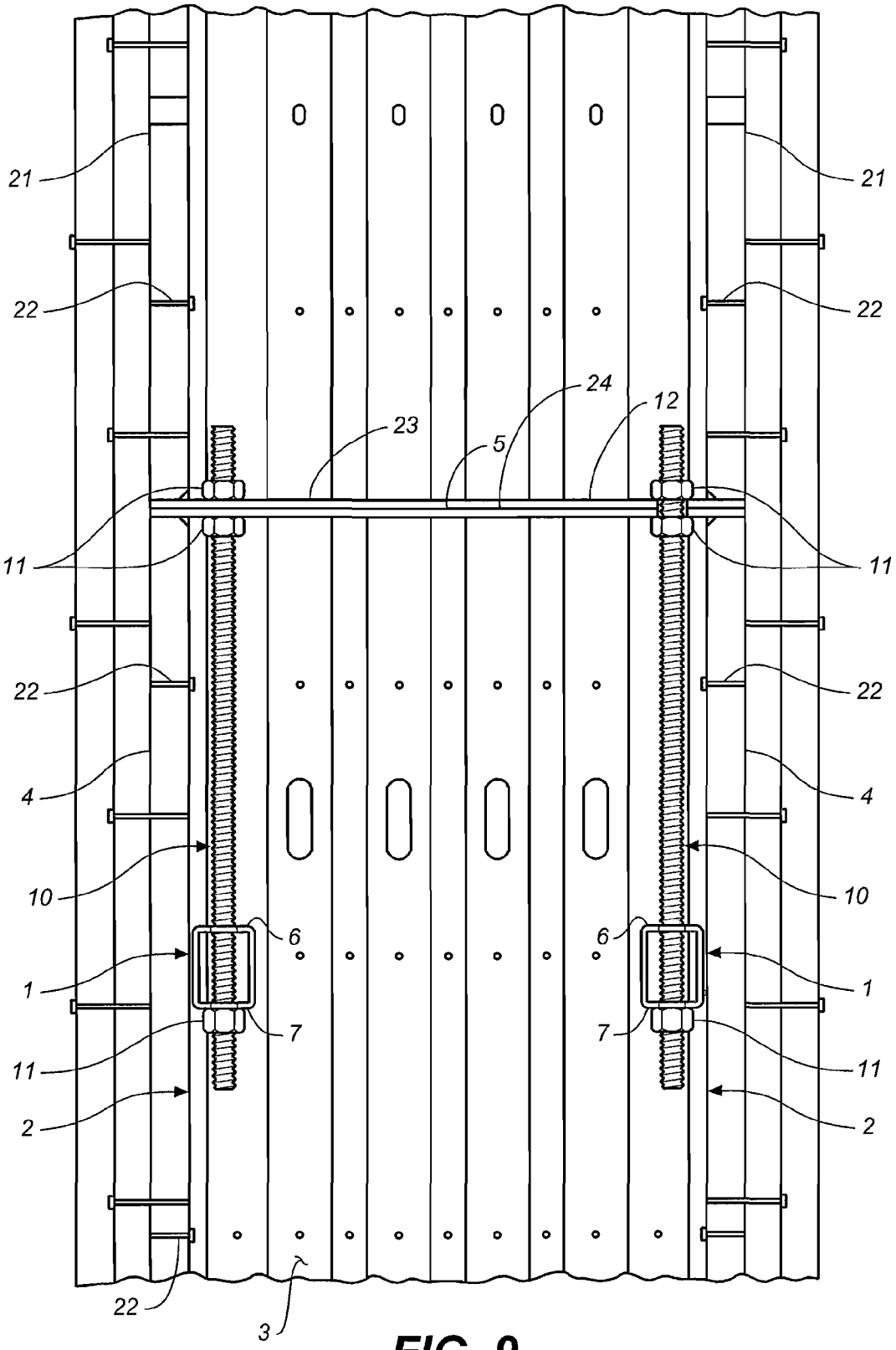
FIG. 9 is an interior elevation view of two prefabricated shearwalls connected together appropriate for balloon framing construction.
Figure 10:
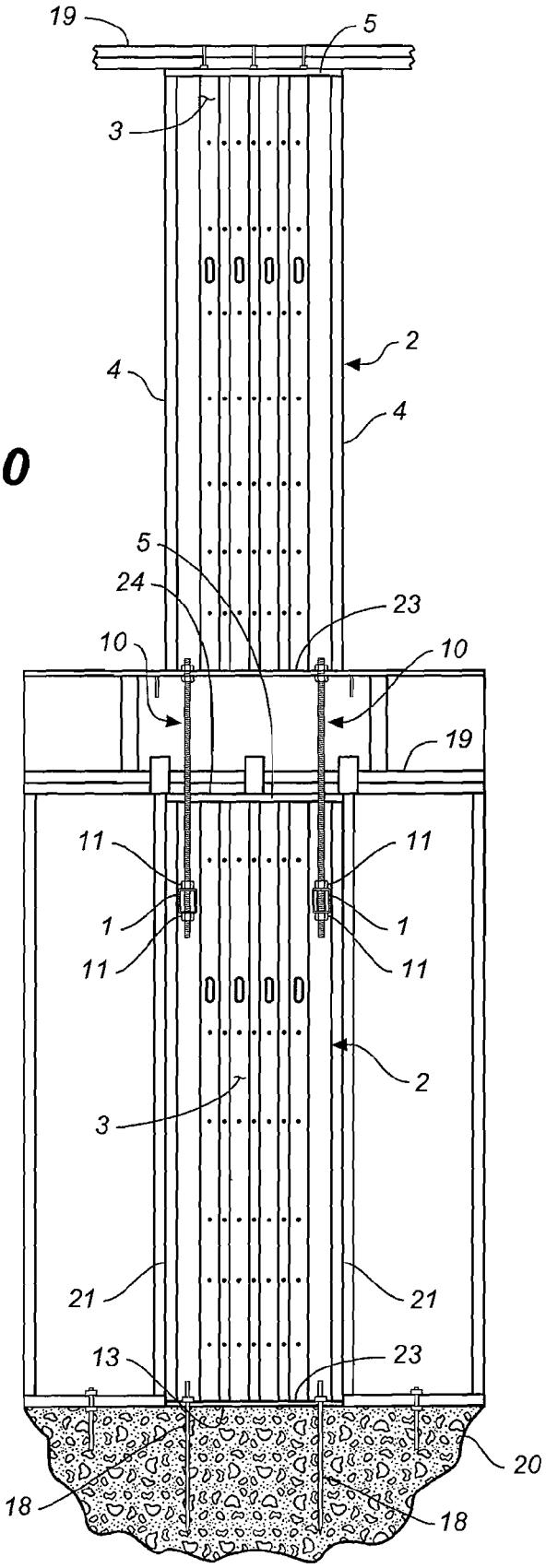
FIG. 10 consists of an interior elevation view of an upper story prefabricated shearwall attached to a lower story prefabricated shearwall by means of continuity ties of the present invention.

In the preferred embodiment, the present invention provides a continuity tie 1 attached to a prefabricated shearwall panel 2 including a central diaphragm 3 having a non-planar cross-section.

In the preferred embodiment, the continuity tie 1 is a tubular steel member welded to the sides or ends 4 and the diaphragm 3 of the prefabricated shearwall 2 near the top edge 5 of the shear wall 2. The continuity ties 1 are located near the top of the shearwall 2 to connect the upper portion of the shearwall 2 to a structural member, such as another prefabricated shearwall 2, disposed above the shearwall 2 with the inventive continuity ties 1. The tubular steel member is provided with a top surface 6 and a bottom surface 7. Substantially aligned openings 8 are provided in the top and bottom surfaces 6 and 7 of the tubular steel member. Side members 9 connect the top and bottom surfaces 6 and 7.

To connect the lower shearwall 2 to the upper structural member, in the preferred embodiment, a threaded rod 10 is run all the way through the continutity tie 1. Nuts 11 are attached top surface 6 and the bottom surface 7 of the continuity tie 1. The threaded rod 10 reaches up to another attachment member 12 on a structural member and one or more nuts 11 are used to attach the threaded rod 10 to the upper attachment member 12.

The upper attachment member 12 could be another tubular continuity tie 1 attached to a prefabricated shearwall 2.

It is also contemplated that the continutity tie 1 could be a plate welded to the prefacticated shearwall 2, rather than a tubular member. The plate need not be be complete, and surround an opening 8 in the plate, it could just be notched. While threaded rod 10 and nuts 11 are preferred other members for connecting to the continuity tie 1 below and the attachment point 12 above are contemplated, including welding rods to the continuity ties 1 or attachment points 12.

In the preferred embodiment of the shearwall 2 used with the present invention, the central diaphragm 3 includes a top edge 5 and a bottom edge 13 generally defining the height of the central diaphragm 3, and a pair of end sections 4 generally defining the width of the central diaphragm 3. The diaphragm 3 further includes a corrugation 14 defined by one or more rear planar sections 15, one or more angled sections 16, and one or more front planar sections 17. While the corrugation 14 is shown comprised of planar sections joined at angles with respect to each other, it is understood that the corrugation 4 may have different configurations 14 in alternative embodiments. As used herein, a corrugation 14 may be any ridge, groove or angle formed in central diaphragm 3 extending in the height direction at least partially between the top edge 5 and the bottom edge 13. The ridge, groove or angle lies in between the end sections 4 in a plane different from that of an adjacent section which also extends in the height direction between the top and bottom edges 5 and 13 in between the end sections 4.

In embodiments of the present invention, the central diaphragm 3 may have an overall height of 93¼ inches, an overall width of 12 inches, and a depth of 2¾ inches. It is understood that each of these dimension may be varied in alternative embodiments, both proportionately and disproportionately with respect to each other. For example, in one alternative embodiment, the central diaphragm 3 may have an overall width of 18 inches. In embodiments where the overall width is 12 inches, the end sections 4 may each be 2¾ inches wide, the rear planar sections 15 may each be 3 inches wide, the angled sections 16 may each be 4¼ inches wide, and the front planar section 17 may be 1½ inches wide. In embodiments of the present invention, the central diaphragm 3 may be formed of 10-gauge sheet steel (0.129 Inches). Other gauges, such as for example 7-gauge sheet steel, and other materials of comparable strength and rigidity may be used in alternative embodiments. One such alternative material may be expanded steel.

The top and bottom edges 5 and 13 of the central diaphragm 3 may be provided with U-shaped channels. These U-shaped channels may be formed of ¼ inch steel plate bent into a U shape. Each channel may be as long as the central diaphragm 3 is wide. The front and back edges of the channels may extend a few inches over the top and bottom of the central diaphragm 3, and the front and back edges may include scallops to facilitate fastening of the bolts 18 securing the central diaphragm 3 to the top plate 19 and underlying surface 20 as explained hereinafter. The channels may be affixed in their respective positions on the central diaphragm 3 by welding, bolting, gluing and other known affixation methods. As used here, gluing refers to the application of any of one or more known compounds (including adhesives and epoxies) to at least portions of the interface between the channels and central diaphragm which cause the channels and central diaphragm to stick to each other. The U-shaped channels may be omitted in alternative embodiments.

In embodiments of the present invention, the shearwall may further include a pair of reinforcing chords 21 affixed to the end sections 4. The chords 21 may be formed of wood, such as for example sawn lumber from lumber groups including spruce-pine-fir, Douglas fir-larch, hem-fir and southern pine. The chords 21 may alternatively be formed of engineered lumber, such as glulam and wood composites. Other types of wood are contemplated. The chords 21 may have a height equal to that of the central diaphragm 3 and of dimension to fit with the other members of the wall into which the prefabricated shearwall 2 is inserted, for example, nominal 2"×4" lumber. Various affixing mechanisms may be used to affix the chords 21 to the central diaphragm 3, such as for example a plurality of ¼ inch.times.1½ inch Simpson Strong-Drive® screws 22. Other types of screws 22 and affixation methods are contemplated, such as for example gluing. As used in this regard, gluing refers to the application of any of one or more known compounds (including adhesives and epoxies) to at least portions of the interface between the chords and central diaphragm which cause the chords and central diaphragm to stick to each other. In embodiments employing screws 22, the screws 22 may be provided in each chord 21 along a single column and spaced apart 6 to 12 inches from each other. It is understood that the screws 22 may be provided in more than one column, or not aligned in a column, down the length of the chords, and may be spaced apart more or less than 6 to 12 inches in alternative embodiments.

Shearwall 2 further includes a sill plate 23 affixed to the bottom 13 of the central diaphragm 3. This allows shearwall 3 to have a lower load bearing surface with a sufficient surface area to allow distribution of the shearwall 2 compressive forces over a sufficiently large area on the underlying floor diaphragm 20 or foundation 20. If the compressive forces from the shearwall 2 are concentrated, for example in a situation where the bottom plate 23 is small or is shaped with channels so that only a portion of the bottom plate lies 23 in contact with the underlying support surface 20, the resulting compressive forces can damage or cause failure in the underlying support surface 20.

Accordingly, sill plate 23 is provided as a flat plate with a relatively large surface area. The plate 23 has a length which is preferably equal to that of the central diaphragm 3 and the chords 21 together, and a width that is equal to the width of the chords 21.

Sill plate 23 is also rigid enough to allow even distribution of any localized compressive forces from the shearwall 2. In one embodiment of the present invention, the sill plate 23 is formed of ½ inch thick steel. The rigidity of the sill plate 23 further prevents buckling of the shearwall 2 under laterally applied loads. It is understood that sill plate 23 may have thicknesses other than ½ inch in alternative embodiments.

It is a further feature of the sill plate 23 to underlie the chords 21, thereby preventing their contact with the underlying support surface. In embodiments of the present invention where the shearwall 2 is mounted on a foundation 20, the sill plate 23 isolates the chords 21 from wetness and moisture from the foundation 20 which may otherwise weaken and erode the chords. The provision of the sill plate 23 under the chords 21 also allows the compressive forces exerted specifically by the chords 21 to be evenly distributed over the sill plate 23 and onto the underlying support surface 20 as described above.

Typically the prefabricated shearwall 2 on the first floor is supported by a support surface comprises a concrete building foundation 20, but it is understood that underlying support surface 20 may be any surface on which a conventional shearwall 2 may be located, including for example a floor diaphragm on the building foundation 20 or a floor diaphragm on a top plate 19 of a lower floor. The shearwall 2 is fastened to the underlying support surface 20 by means of anchors or bolts 18 protruding up through aligned holes formed in the sill plate 29. The nuts 11 are then fastened over threaded ends of anchors 18 to anchor the shearwall 2 to the underlying support surface 20. It is understood that shearwall 2 may be anchored to the underlying support surface 20 by other anchoring mechanisms in alternative embodiments, such as for example by strap anchors, mudsill anchors, retrofit bolts, foundation plate holdowns, straps, ties, nails, screws, framing anchors, ties, plates, straps or a combination thereof. The shearwall 2 may alternatively or additionally be fastened to the underlying support surface 20 by gluing, which in this context refers to the application of any of one or more known compounds (including adhesives and epoxies) to at least portions of the interface between the shearwall 2 and underlying surface 20 which cause the shearwall 2 and underlying surface 20 to stick to each other.

Shearwall 2 may similarly include openings in the top chord 24 at the top end 5 for affixation to a top plate 19 of a wall as by welding, bolts 18 and/or other anchoring mechanisms described above. The central diaphragm top chord 24 and top plate 19 may additionally or alternatively be affixed to each other as by gluing, which refers to the application of any of one or more known compounds (including adhesives and epoxies) to at least portions of the interface between the central diaphragm 3, top chord 24 and/or top plate 19 which cause the central diaphragm 3, top chord 24 and/or top plate 19 to stick to each other.

A further embodiment of the present invention including stiffening lips 25 formed in the horizontally oriented edges of end sections 4. The lips 25 may be formed inwardly, or the lips 25 may be outwardly. The stiffening lips 25 may be provided to add additional strength to the diaphragm 3.

We claim:

1. A connection between a prefabricated shearwall, located in a substantially planar wall, and an upper structural member disposed above the prefabricated shearwall, the connection comprising:

a. a prefabricated shearwall located in a lower story of a multi-story building, the shearwall having sufficient strength to contribute to opposing seismic or wind lateral forces on the building, the prefabricated shearwall being fastened to an underlying support surface, the shearwall having a central diaphragm, the central diaphragm having two ends and a top edge and a bottom edge, a width, a height and a depth with the width of the diaphragm being at least twice as great as the depth of the diaphragm, the central diaphragm further having two interior, rear planar sections, the rear planar sections being disposed vertically, each of the rear planar sections being adjacent one of the two ends of the central diaphragm with the rear planar sections of the central diaphragm being disposed in substantial alignment with the plane of the wall in which the shearwall is located, and each end of the central diaphragm being disposed at an angle to the rear planar section to which it is adjacent;

b. a continuity tie attached to one of the rear planar sections of the diaphragm of the shearwall near, but below the top edge of the diaphragm, the continuity tie having a top surface and a bottom surface, the continuity tie being a tubular member where the top surface and bottom surface are the separated top and bottom walls of the tubular member, and side members integrally connect the top and bottom walls of the tubular member, and the top and bottom walls and the side members define a through bore in the tubular member, the through bore being oriented horizontally, and disposed within the top and bottom surfaces are aligned openings that receive an elongated rod member;

c. the elongated rod member that is received by and is attached to the continuity tie;

d. the upper structural member that receives and is attached to the elongated rod member, the upper structural member being located above the shearwall.

2. The connection of claim 1, wherein:

the elongated rod member is connected to the continuity tie by means of a pair of nuts threaded onto the elongated rod member and the nuts are disposed against the top and bottom surfaces of the continuity tie.

3. The connection of claim 1, wherein:

the diaphragm has a non-planar cross-section.

4. The connection of claim 3, wherein:

the diaphragm includes a corrugation, having one or more of said rear planar sections, one or more angled sections, and one or more front planar sections.

5. The connection of claim 1, wherein:

the continuity tie is made from steel and the central diaphragm of the shearwall is made from steel.

6. The connection of claim 5, wherein:

the continuity tie is connected to the diaphragm of the shearwall by welding one or more of the top wall, the bottom wall and a side member to the diaphragm of the shearwall.

7. The connection of claim 6, wherein:

the continuity tie is welded to the end of the central diaphragm adjacent the rear planar section to which the continuity tie is attached near the top edge of the shearwall.

8. The connection of claim 1, wherein:

the continuity tie is also attached to the end of the central diaphragm adjacent the rear planar section to which the continuity tie is attached.

9. The connection of claim 1, further comprising:

a. a second continuity tie attached to the other of the rear planar sections of the diaphragm of the shearwall near, but below the top edge of the diaphragm, the second continuity tie having a top surface and a bottom surface, the second continuity tie being a tubular member where the top surface and bottom surface are the separated top and bottom walls of the tubular member, and side members integrally connect the top and bottom walls of the tubular member, and the top and bottom walls and the side members define a through bore in the tubular member, the through bore being oriented horizontally, and disposed within the top and bottom surfaces are aligned openings that receive an elongated rod member;

b. the second elongated rod member that is received by and is attached to the second continuity tie;

c. the upper structural member that receives and is attached to the elongated rod member, the upper structural member being located above the shearwall.

10. The connection of claim 9, wherein:

the second continuity tie is also attached to the end of the central diaphragm adjacent the rear planar section to which the second continuity tie is attached.

11. The connection of claim 10, wherein:

the second elongated rod member is connected to the second continuity tie by means of a pair of nuts threaded onto the elongated rod member and the nuts are disposed against the top and bottom surfaces of the second continuity tie.

12. The connection of claim 11, wherein:

the central diaphragm of the shearwall is made from steel.

13. The connection of claim 12, wherein:

the upper structural member that receives and is attached to the elongated rod member is a second shearwall.

14. The connection of claim 13, wherein:

the second shearwall rests directly on the first shearwall.

15. The connection of claim 14, wherein:

the second continuity tie is connected to the diaphragm of the shearwall by welding one or more of the top wall, the bottom wall and a side member to the diaphragm of the shearwall.

16. The connection of claim 15, wherein:

the continuity tie is welded to the end of the central diaphragm adjacent the rear planar section to which the continuity tie is attached near the top edge of the shearwall.

17. The connection of claim 1, wherein:

the upper structural member that receives and is attached to the elongated rod member is a second shearwall.

18. The connection of claim 17, wherein:

the second shearwall rests directly on the first shearwall.

19. The connection of claim 18, wherein:

the continuity tie is connected to the diaphragm of the shearwall by welding one or more of the top wall, the bottom wall and a side member to the diaphragm of the shearwall.

20. The connection of claim 19, wherein:

the continuity tie is welded to the end of the central diaphragm adjacent the rear planar section to which the continuity tie is attached near the top edge of the shearwall.

* * * * *

UNITED STATES PATENT AND TRADEMARK OFFICE

CERTIFICATE OF CORRECTION

PATENT NO. : 8,689,518 B2
APPLICATION NO. : 12/449962
DATED : April 8, 2014
INVENTOR(S) : Jerry G. Gridley et al.

It is certified that error appears in the above-identified patent and that said Letters Patent is hereby corrected as shown below:

Title page, item 75 should read as follows:

Inventors:
Jerry G. Gridley, Grass Valley, CA (US)
Emory L. Montague, Pleasanton, CA (US)
Paul B. McEntee, Pleasanton, CA (US)
Ricardo M. Arevalo, Pleasanton, CA (US)

Title page, item 73 should read as follows:

Assignee: SIMPSON STRONG-TIE COMPANY, INC., PLEASANTON, CA (US)

Signed and Sealed this
Twenty-second Day of December, 2015

Michelle K. Lee

Michelle K. Lee
*Director of the United States Patent and Trademark Office*